US011841203B2

(12) United States Patent
Shea

(10) Patent No.: US 11,841,203 B2
(45) Date of Patent: Dec. 12, 2023

(54) ACTION TIMER SWITCH AND SYSTEM FOR INTERNAL BALLISTIC MEASUREMENTS

(71) Applicant: General Dynamics-OTS, Inc., St. Petersburg, FL (US)

(72) Inventor: Lex Shea, Tallahassee, FL (US)

(73) Assignee: General Dynamics-OTS, Inc.

( * ) Notice: Subject to any disclaimer, the term of this patent is extended or adjusted under 35 U.S.C. 154(b) by 467 days.

(21) Appl. No.: 16/947,519

(22) Filed: Aug. 5, 2020

(65) Prior Publication Data

US 2022/0042761 A1 Feb. 10, 2022

(51) Int. Cl.
*F41A 31/00* (2006.01)
*H01H 1/58* (2006.01)

(52) U.S. Cl.
CPC ..... *F41A 31/00* (2013.01); *H01H 1/58* (2013.01)

(58) Field of Classification Search
CPC ..... F41A 31/00; H01H 1/58; H01H 39/004
USPC ..... 73/167
See application file for complete search history.

(56) References Cited

U.S. PATENT DOCUMENTS 3,283,658 A * 11/1966 Knight ..... F41A 19/58 73/167
4,341,031 A * 7/1982 Palmer ..... F41A 3/10 42/23
6,286,241 B1 * 9/2001 Constant ..... F41A 19/58 42/84
2013/0283660 A1 * 10/2013 Matthews ..... F41G 1/26 42/118

OTHER PUBLICATIONS

Cannatech, Inc., Breechblock Assembly sheet, PN13200-40A.
Kistler Group, Kistler Systems Solutions for Ballistic Applications, www.kistler.com, Switzerland, 2019.

* cited by examiner

*Primary Examiner* — Rexford N Barnie
*Assistant Examiner* — Xuan Ly
(74) *Attorney, Agent, or Firm* — LKGlobal | Lorenz & Kopf LLP

(57) ABSTRACT

An action timer start switch, a breech block with an integral action timer start switch and a system for measuring internal ballistic data in a test weapon system are described herein. The action timer start switch includes a through-hammer adjustable contact having a first contact element and a contact switch supported on the breech block having a second contact element. The first contact element is adjustable for contacting the second contact element when the hammer is a position to generating a primer strike. The first contact element may be set by simply positioning the breech block in the in-battery position with the hammer in the ignition position and moving the adjustable contact relative to the contact switch through the breech of the universal receiver.

19 Claims, 7 Drawing Sheets

ACTION TIMER SWITCH AND SYSTEM FOR INTERNAL BALLISTIC MEASUREMENTS

FIELD

The present disclosure relates to internal ballistic analysis and more particularly to an action timer switch for measuring the start time when conducting internal ballistic testing.

BACKGROUND

This section is intended to provide background information related to the present disclosure which may not necessarily represent prior art.

Internal ballistics are events within the components of a firearm that occur over the time period between the hammer impacting the firing pin and the bullet exiting the muzzle. External ballistics, on the other hand, are events that occur over the time period between the bullet exiting the muzzle and striking a target downrange or dropping to the ground. The present disclosure focuses on measurements for internal ballistics.

Internal ballistic measurements, such as pressure-time or P-T curves, are used to evaluate the characteristics, quality and safety of propellants and ammunition. As such it is important to obtain very accurate and repeatable time measurement over multiple testing rounds. In conventional action timer switches, the hammer strikes a spring-loaded ball switch to generate a start signal. Over time and multiple rounds, the ball face may become flattened and/or the spring may become fouled causing the ball to stick in the switch and not return to its design-intent position. These changes introduce an increased gap between the hammer and the ball face that results in delayed switch closures and apparent shortening of the action time measured with such switches.

To achieve accurate and repeatable results, the conventional action timer switch must be frequently cleaned and re-calibrated. The adjustment mechanism for these conventional switches can only be accessed from the front face of the breech block. As a result, the test barrel has to be removed from the universal receiver, then the breech block must be moved to the out-of-battery position with the barrel in a vise to safely hold the universal receiver during ball plunger adjustment.

Accordingly, there is a need in the art to provide a robust action timer start switch that provides accurate and repeatable timing signals, is resistant to fouling over time and multiple rounds and may be quickly and easily calibrated without having to disassembly the weapon test system.

SUMMARY

This section is intended to provide a general summary of the present disclosure and is not a comprehensive discussion of the full scope or all features provided herein.

In one aspect, the present disclosure provides an action timer start switch for a breech block having a firing pin. The action timer start switch includes a hammer configured to be supported in the breech block. The hammer has a hammer body with a poll extending from a first edge of the hammer body and terminating at a hammer face. The hammer face is configured to contact the firing pin when the hammer is in an ignition position. An adjustable contact is supported in the hammer body and extends through the first edge. The adjustable contact terminates at a first contact element that is positionable relative to the hammer face. A contact switch is configured to be fixedly supported on the breech block. The contact switch has a second contact element electrically coupled to a test lead. The first contact element contacts the second contact element when the hammer is in the ignition position for transmitting a start pulse in the test lead.

In another aspect, the present disclosure provides a breech block with an action timer switch incorporated therein. The breech block includes a breech block body and a firing pin assembly having a firing pin plate supported in the breech block body and a firing pin slidably supported in the firing pin plate. The firing pin is movable between a first position with the firing pin retracted into the breech block body and a second position with at least a portion of the firing pin extending from the firing pin plate. A hammer is pivotally supported in the breech block body and includes a hammer body having a poll extending from a first edge and terminating at a hammer face. The hammer is pivotable with respect to the breech block body for bringing the hammer face into contact with the firing pin. An action start timer switch includes an adjustable contact supported in the hammer body, which extends through the first edge and terminates at a first contact element that is positionable relative to the hammer face. A contact switch is fixedly supported in the breech block body and has a second contact element electrically coupled to a test lead. The first contact element contacts the second contact element when the hammer face contacts the firing pin for transmitting a start pulse in the test lead.

In yet another aspect, the present disclosure provides a system for conducting internal ballistic measurements. The system includes a universal receiver having a barrel extending from the universal receiver and a breech block with an action timer incorporated therein. The universal receiver has a breech and a breech block bore formed therein. The barrel has a first end adjacent the breech block bore forming a chamber region for receiving an ammunition round therein, a second end opposite the first end forming a muzzle region and a rifled bore extending from the chamber region to the muzzle region. The breech block is positionable in the breech block bore between an out-of-battery position for exposing the chamber region and an in-battery position for sealing the chamber region. The breech block includes a breech block body and a firing pin assembly having a firing pin slidable supported in a firing pin plate for moving between a first position with the firing pin retracted into the firing pin plate and a second position with at least a portion of the firing pin extending from the firing pin plate. A hammer is pivotally supported in the breech block body and includes a hammer body having a poll extending from a first edge and terminating at a hammer face. The hammer is pivotable with respect to the breech block body for bringing the hammer face into contact with the firing pin. The action start timer switch includes an adjustable contact supported in the hammer body and a contact switch supported in the breech block body. The adjustable contact extends through the first edge and terminates at a first contact element that is positionable relative to the hammer face. The contact switch includes a second contact element electrically coupled to a test lead. The first contact element contacts the second contact element when the hammer face contacts the firing pin for transmitting a start pulse in the test lead.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments which do not represent all feasible implementations and are not intended to limit the scope of the claimed subject matter.

Corresponding reference numerals indicate corresponding parts throughout the several views of the drawings.

DETAILED DESCRIPTION

Example embodiments will now be described more fully with reference to the accompanying drawings.

The present disclosure describes various embodiments including an action timer start switch, a breech block with an integral action timer start switch and a system for measuring internal ballistic data in a test weapon system. In these embodiments, the action timer start switch includes a through-hammer adjustable contact having a first contact element and a contact switch supported on the breech block having a second contact element. The first contact element is adjustable for contacting the second contact element when the hammer is in the ignition position. The position of the first contact element may be set by simply positioning the breech block in the in-battery position with the hammer in the ignition position and moving the adjustable contact relative to the contact switch through the breech of the universal receiver. Since this adjustment is made from the rear of the universal receiver through the breech, it can be made without having to remove the barrel from the front of the universal receiver. In addition, the action timer start switch does not have a spring-biased contact element that may get flattened or fouled from firing multiple ammunition rounds during ballistic testing.

Figure 1:
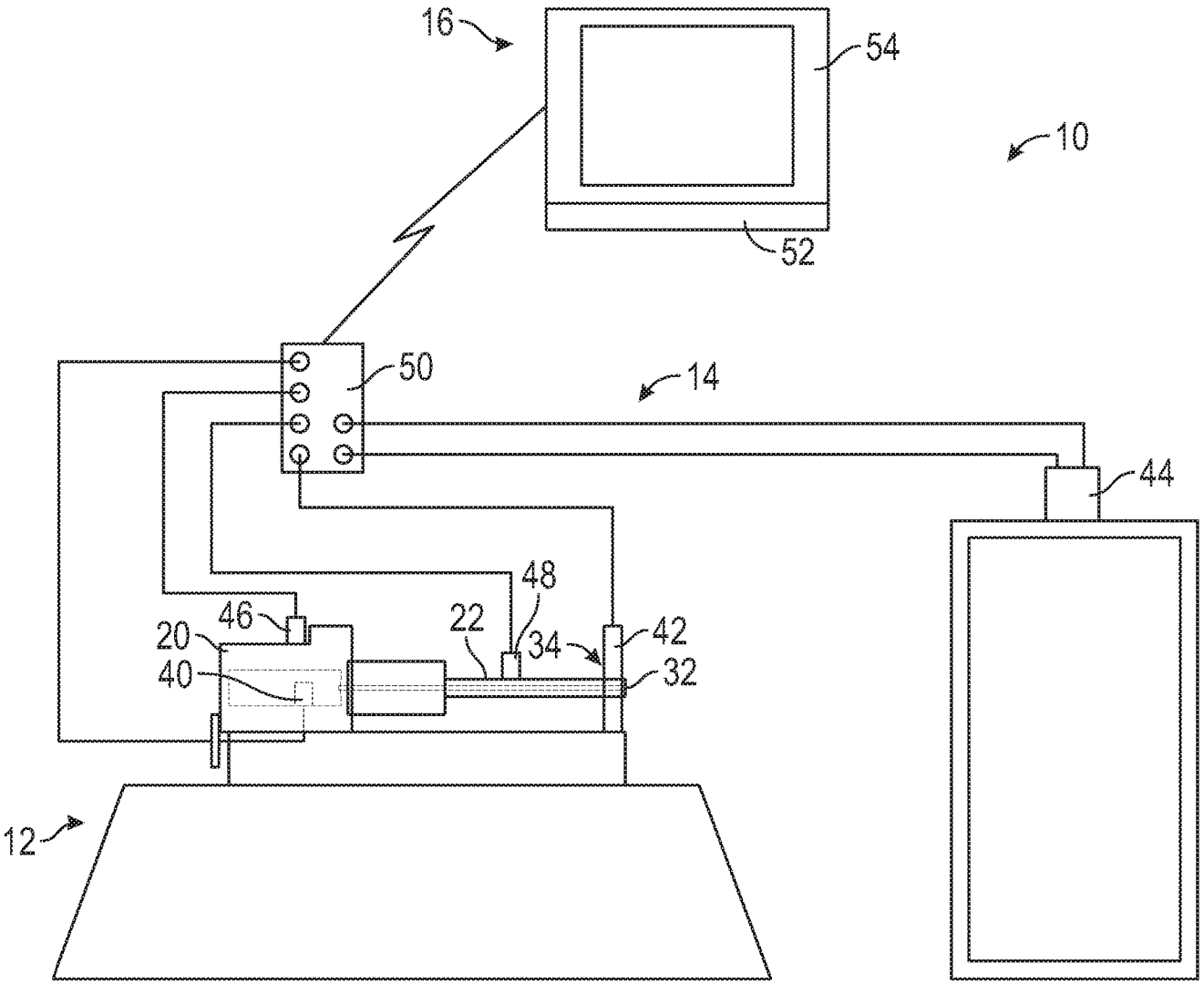
FIG. 1 is a schematic representation of a ballistics testing fixture.

With reference now to FIG. 1, a ballistic testing system 10 is configured to conduct internal and external ballistics analysis. The system 10 includes a test weapon system 12 for repeatedly firing ammunition during ballistics testing, a data collection system 14 for measuring, recording and storing ballistics data during ballistics testing and a data analysis system 16 for processing and analyzing the ballistic data.

Figure 2:
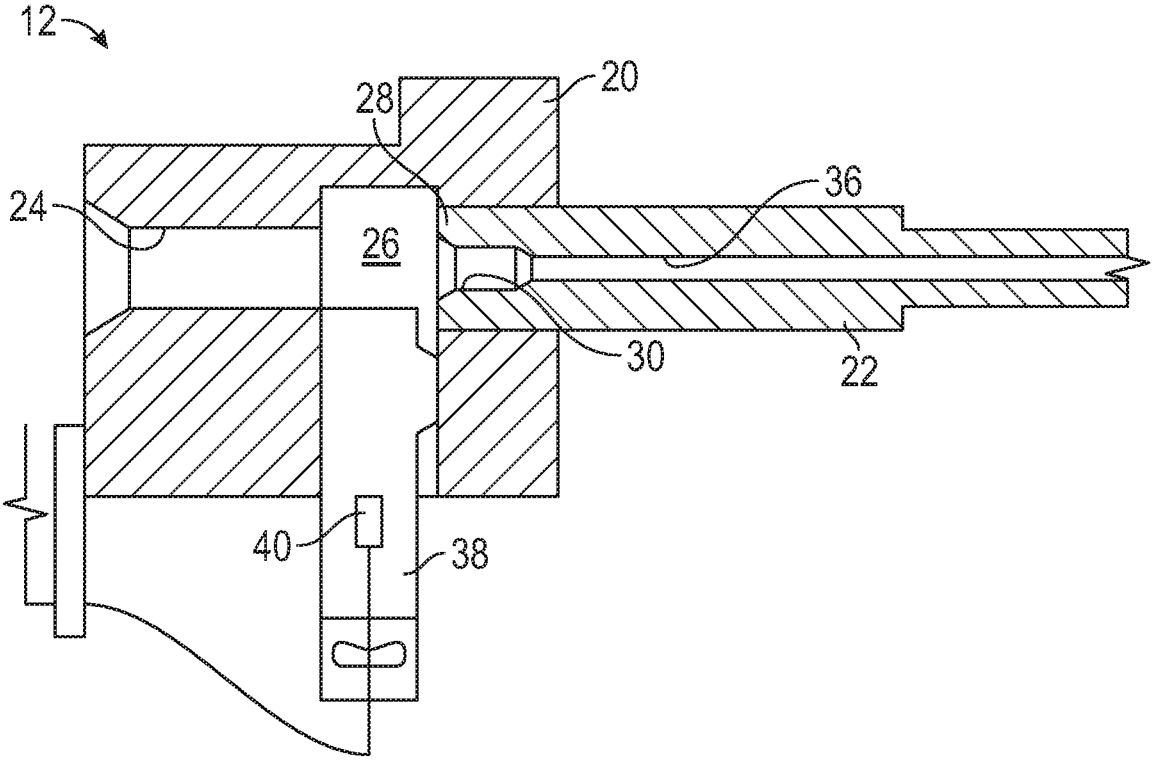
FIG. 2 is a schematic cross-section of showing the receiver and a portion of the barrel with the breech block in the out-of-battery position.
Figure 3:
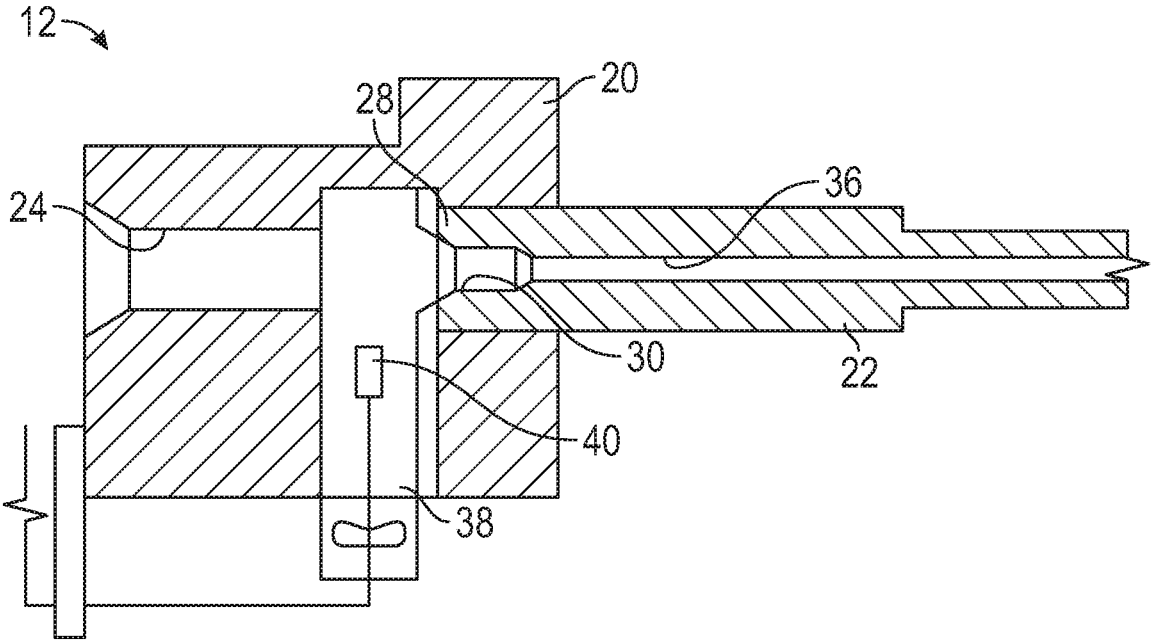
FIG. 3 is a schematic cross-section similar to FIG. 2 showing the breech block in the in-battery position.
Figure 5:
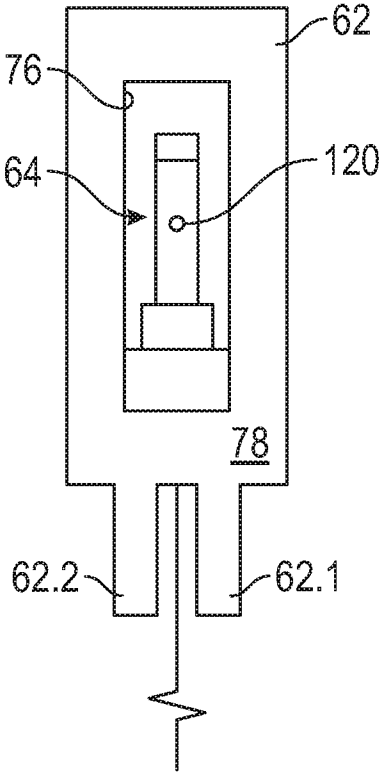
FIG. 5 shows a rear surface of the breech block shown in FIG. 4.
Figure 4:
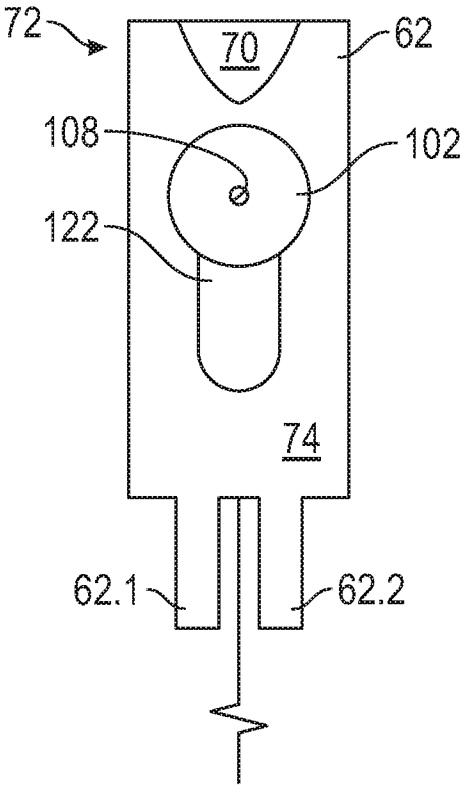
FIG. 4 shows a front surface the breech block equipped with an action timer start switch.

With reference to FIGS. 1-3, the test weapon system 12 includes a universal receiver 20 having a barrel 22 extending therefrom. The universal receiver 20 has a breech 24 and a breech block bore 26 formed therein. The barrel 22 has a first end 28 adjacent the breech block bore 26 forming a chamber region 30 for receiving an ammunition round (not shown) therein. A second end 32 of the barrel 22, opposite the first end 28, forms a muzzle region 34 of the barrel 22. A rifled bore 36 extends from the chamber region 30 to the muzzle region 34. As best seen in FIGS. 2 and 3, the breech block bore 26 is formed generally perpendicular to the bore 36 of the barrel 22. The barrel 22 may be removably attached to the universal receiver 20 so that various caliber ammunition may be fired from the test weapon system 12. A breech block 38 is operably supported in the breech block bore 26 of the universal receiver 20. The breech block 38 reciprocates in the breech block bore 26 between an out-of-battery position (FIG. 2) for exposing the chamber region 30 and an in-battery position (FIG. 3) for sealing the chamber region 30. Further details about the structure and operation of the breech block 38 are provide hereinafter.

With continued reference to FIGS. 1-3, the data collection system 14 includes various switches, probes, sensors and/or other data collection devices, which measure, record and store ballistics data. The data collection system 14 includes an action timer start switch 40, an action timer stop probe 42 and a target sensor 44. The action timer start switch 40 generates a start pulse when a hammer is in the ignition position to generate a primer strike in an ammunition round. The action timer stop probe 42 generates a stop pulse when a projectile from the ammunition round exits the muzzle region 34 of the barrel 22. In one embodiment, the action timer stop probe 42 may be an antenna bar disposed around the muzzle region 34 of the barrel 22. The total time from primer strike to projectile exit is referred to as the ignition barrel time or action time. The target sensor 44 generates an end pulse when the projectile passes through a target plane down range from the test weapon system 12.

The data collection system 14 also include a chamber sensor 46 and a barrel sensor 48. The chamber sensor 46 is a pressure transducer in fluid communication with the chamber region 30 of the barrel 22 for measuring pressure in the chamber region 30 over the barrel ignition time. Similarly, the barrel sensor 48 is a pressure transducer in fluid communication with the rifled bore 36 between the chamber region 30 and the muzzle region 34. A data recorder 50 is electrically coupled to the switch 40, probe 42 and sensors 44-48 for monitoring and recording ballistics data including start pulses, stop pulses, end pulses and pressure values as a function of time during an ammunition firing event.

With reference to FIG. 1, the data analysis system 16 includes a ballistics data processor 52, which may be in the form of a computer or similar processor, and a display 54. The ballistics data processor 52 is in communication with the data recorder 50 to execute various input functions, mathematical operations and output functions for receiving, analyzing, displaying and outputting the internal and external ballistics information. The data recorder 50 and/or the data processor 52 may include analog-to-digital convertors (ADCs) for converting analog signals generated by the switch 40, probe 42 and sensors 44-48 into digital ballistics data signals, which are processed to obtain the ballistic information.

In accordance with the present disclosure, the action timer start switch 40 is instrumented as part of the breech block 38. With reference now to FIGS. 4-7, the breech block 38 includes a breech block body 62 with a hammer mechanism 64 and a firing pin mechanism 66 operably supported therein. The breech block body 62 is generally cylindrical. A tapered face 70 formed in a top portion 72 of a front surface 74 on the body 62 guides the breech block 38 from the out-of-battery position (FIG. 2) into the in-battery position (FIG. 3). The hammer mechanism 64 is mounted in a first recess 76 formed in a back surface 78 of the body 62. The firing pin mechanism 66 is mounted in a second recess 80 formed in the front surface 74 of the body 62. A pair of bolt extensions 62.1, 62.2 extend downwardly from the body 62 and are configured to couple with a bolt carrier mechanism (not shown) for moving the breech block 38 between the out-of-battery position and the in-battery position.

Figure 6:
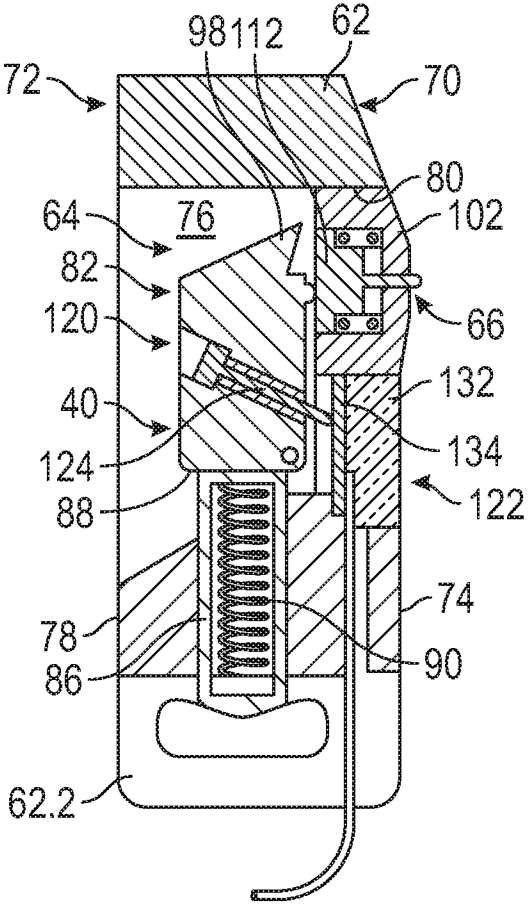
FIG. 6 is a cross-section of the breech block shown in FIGS. 4 and 5.

The hammer mechanism 64 includes a hammer body or simply hammer 82 coupled at a pivot 84 to the body 62. A retainer 86 is supported in the body 62 and extends into the first recess 76 to engage a bottom edge 88 of the hammer 82. A hammer spring 90 is operably coupled between the body 62 and the retainer 86 to bias the hammer 82 in a clockwise direction as seen in FIG. 6. A poll 92 extends from a front edge 94 of the hammer 82 and terminates at a hammer face 96. A trigger catch 98 extends from a top edge 100 of the hammer 82 and is configured to couple with a trigger mechanism (not shown) for selectively cocking and releasing the hammer 82.

The firing pin mechanism 66 includes a firing pin plate 102 detachably secured in the second recess 80 of the body 62. A blind bore 104 is formed in a rear face 106 of the firing pin plate 102. A smaller through bore 108 extends from the blind bore 104 through a front face 110 of the firing pin plate 102. As seen in FIGS. 3 and 6, the front face 110 of the firing pin plate 102 is contoured to seal the chamber region 30 of the barrel 22 when the breech block 38 is in the in-battery position. A firing pin 112 includes a shoulder portion 114 slidably supported in the blind bore 104 and a pin portion 116, which extends from the shoulder portion 114, slidably supported in the through bore 108. A firing pin spring 118 biases the firing pin 112 away from the front face 110 of the firing pin plate 102. The firing pin 112 slides within the firing pin plate 102 such that the pin portion 116 can extend from or retract into the firing pin plate 102.

With continued reference to FIGS. 6-9, the action timer start switch 40 includes an adjustable contact 120 supported in the hammer 82 and a contact switch 122 supported on the breech block body 62. The adjustable contact 120 includes an elongated pin 124 extending through a bore 126 in the hammer 82 from a rear edge 128 of the hammer 82 through the front edge 94, which terminates at a first contact element 130. The first contact element 130 is positioned between the poll 92 and the pivot 84 on the front edge 94 of the hammer 82. The elongated pin 124 is positionable in the bore 126 so that the first contact element 130 can be adjusted relative to the hammer face 96. The contact switch 122 includes an insulator 132 detachably secured to the body 62 and a second contact element 134 supported on the insulator 132 and facing the hammer 82. The insulator 132 electrically isolates the second contact element 134 from the breech block 38. In one embodiment, the insulator 132 may be a phenolic material and the second contact element 134 may be a stainless steel strip secured to the insulator 132. The second contact element 134 is electrically coupled to a test lead 136. The elongated pin 124 may be adjusted relative to the hammer face 96 so that the first contact element 130 contacts the second contact element 134 for transmitting a start pulse in the test lead 136.

Figure 7:
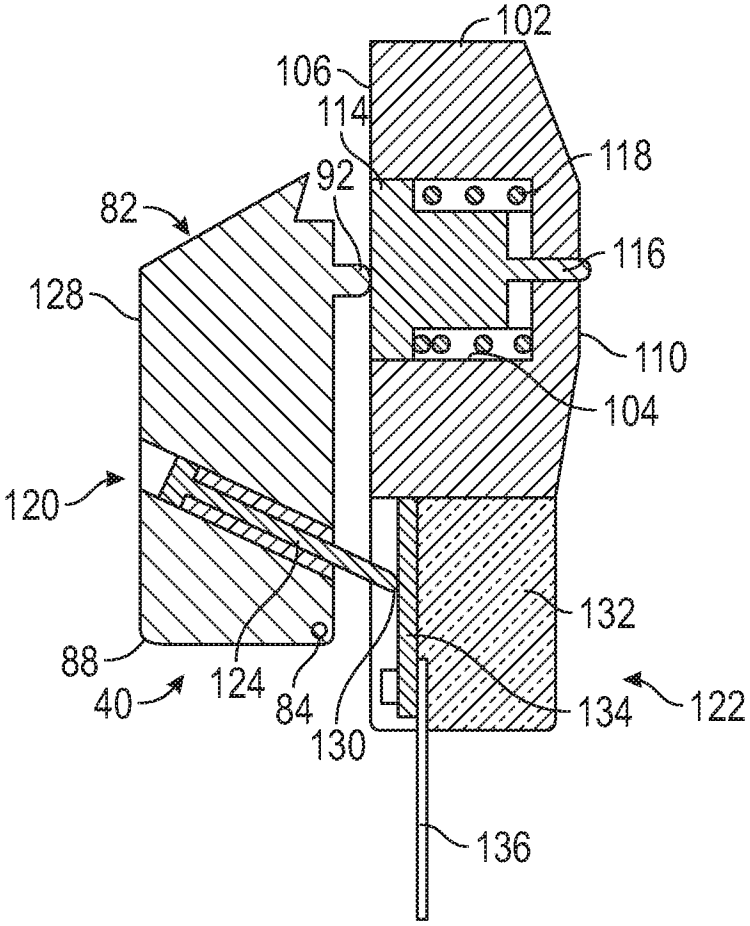
FIG. 7 is a cross-section detail of the action timer start switch shown in FIG. 6.
Figure 8:
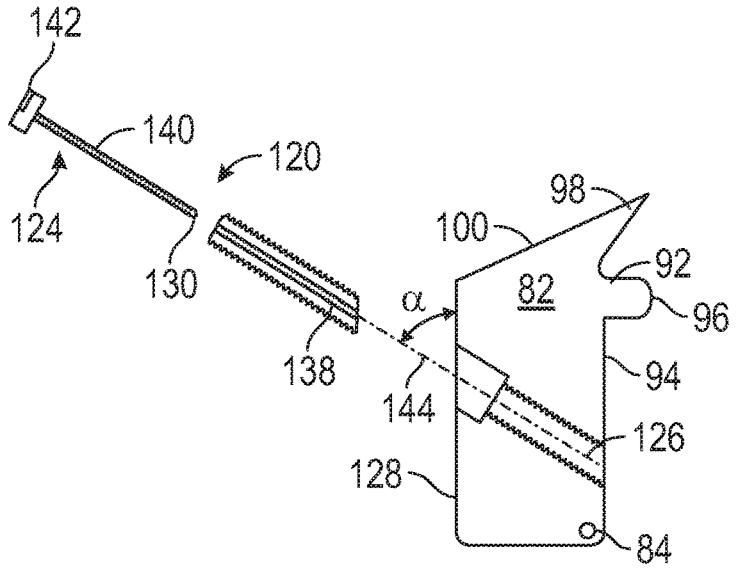
FIG. 8 is a detail showing an embodiment of a through-hammer adjustable contact in the breech block.

With specific reference to FIG. 8, an embodiment of the adjustable contact 120 is illustrated. The bore 126 is configured to receive a helical insert 138 such as a Heli-Coil® insert available from Emhart Teknologies, Inc. The insert 138 is in turn configured to receive a #6×32 threaded adjustment pin 140 having an enlarged head 142 formed at one end of the pin 140 and an opposite end of the pin 140 that is rounded to form the first contact element 130. An axis 144 of the bore 126 is angularly oriented with respect to the hammer 82. More specifically, the lesser include angle ($\alpha$) between the axis 144 and the rear edge 128 of the hammer 82 forms an acute angle greater than 40°, preferably an angle in a range between 65° and 75°, and more preferably an angle of about 70°. As best seen in FIGS. 6 and 7, this angular orientation allows the elongated pin 124 to clear the bottom edge of the firing pin plate 102 as the hammer 82 rotates about the pivot 84. The angular orientation also provides access to the elongated pin 124 at a centered location in the breech 24 on the rear edge 128 of the hammer 82 as best seen in FIG. 11.

Figure 9:
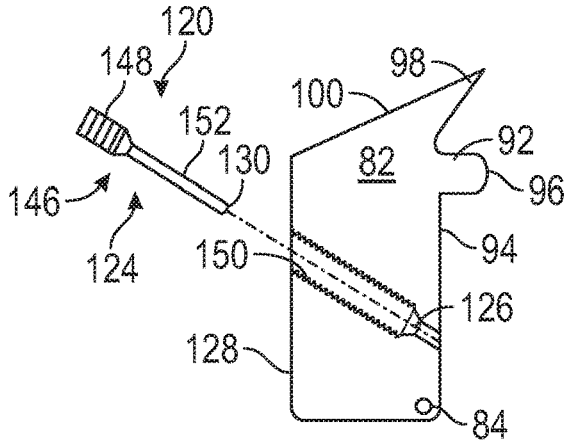
FIG. 9 is a detail showing another embodiment of a through-hammer adjustable contact in the breech block.

With reference now to FIG. 9, another embodiment of the adjustable contact 120 is illustrated. The bore 126 is formed as a counterbore extending from the rear edge 128 to the front edge 94 through in the hammer 82. An adjustment pin 146 has an enlarged threaded portion 148 configured to engage a threaded portion 150 of counterbore 126 and a pin portion 152 configured to extend through the hammer 82 and terminate at a rounded end to form the first contact element 130. A thread locking compound may be applied in the threaded portion 150 of the counterbore 126 to secure the adjustable contact 120 in place.

The hammer 82 may be fabricated using O1 high-speed or tool steel having a thickness of one-quarter inch (0.25"), which requires heat treatment during the fabrication process. The hammer 82 is heated to about 1425° F. then furnace cooled to ambient temperature. At this point the hammer 82 may be bored and tapped for receiving the adjustable contact 120. After machining, the hammer 82 is heated to 1500° F. for 15 minutes, carefully removed from the furnace and quenched in quenching oil to ambient temperature. Finally, the hammer 82 undergoes a stress relieving heat treatment in which the hammer 82 is placed in a cold furnace, heated to 300-500° F. and held for about fifteen minutes, then water cooled to ambient temperature. This process yields a hammer 82 having a Rockwell C hardness in a range between 58 and 64. The adjustable contact 120 can now be assembled into the hammer 82.

Figure 10:
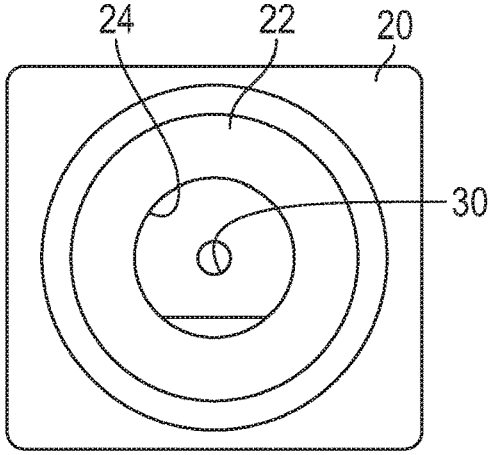
FIG. 10 is a view showing the back of the universal receiver looking into the breech with the breech block in the out-of-battery position as seen in FIG. 2.
Figure 11:
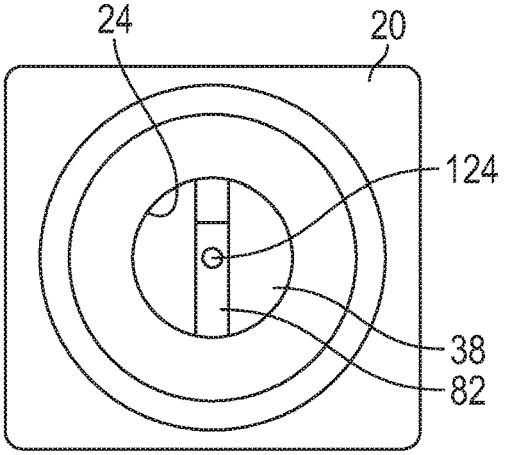
FIG. 11 is a view of the universal receiver similar to FIG. 10 with the breech block in the in-battery position as seen in FIG. 3.

With reference to FIGS. 6, 10 and 11, calibration of the action timer start switch 40 will be explained. First, an empty, unfired ammunition case (not shown) is inserted into the chamber region 30 of the barrel 22. Next, the breech block 38 is positioned from the out-of-battery position (FIG. 10) into the in-battery position (FIG. 11) and the hammer 82 is manually exercised forward (i.e., clockwise as shown in FIG. 6) so that the hammer face 96 engages the firing pin 112 and the pin portion 116 extends from the firing pin plate 102 to initiate contact with a primer on the chambered case. Access to the adjustable contact 120 is provided through the breech 24 from the back of the universal receiver 20 as shown in FIG. 11. The elongated pin 124 is advanced in the bore 126 through the hammer 82 until the first contact element 130 touches the second contact element 134. To ensure that the elongated pin 124 of the adjustable contact 120 is properly calibrated, a continuity tester or ohm meter may be attached to the test lead 136 and the elongated pin 124 is advance until continuity between the first and second contact elements 130, 134 is first established. In this way, the action timer start switch 40 may be calibrated to precisely time the switch closure to the primer strike, and thus setting the action timer start switch 40 to true ignition start (Time Zero).

Figure 12:
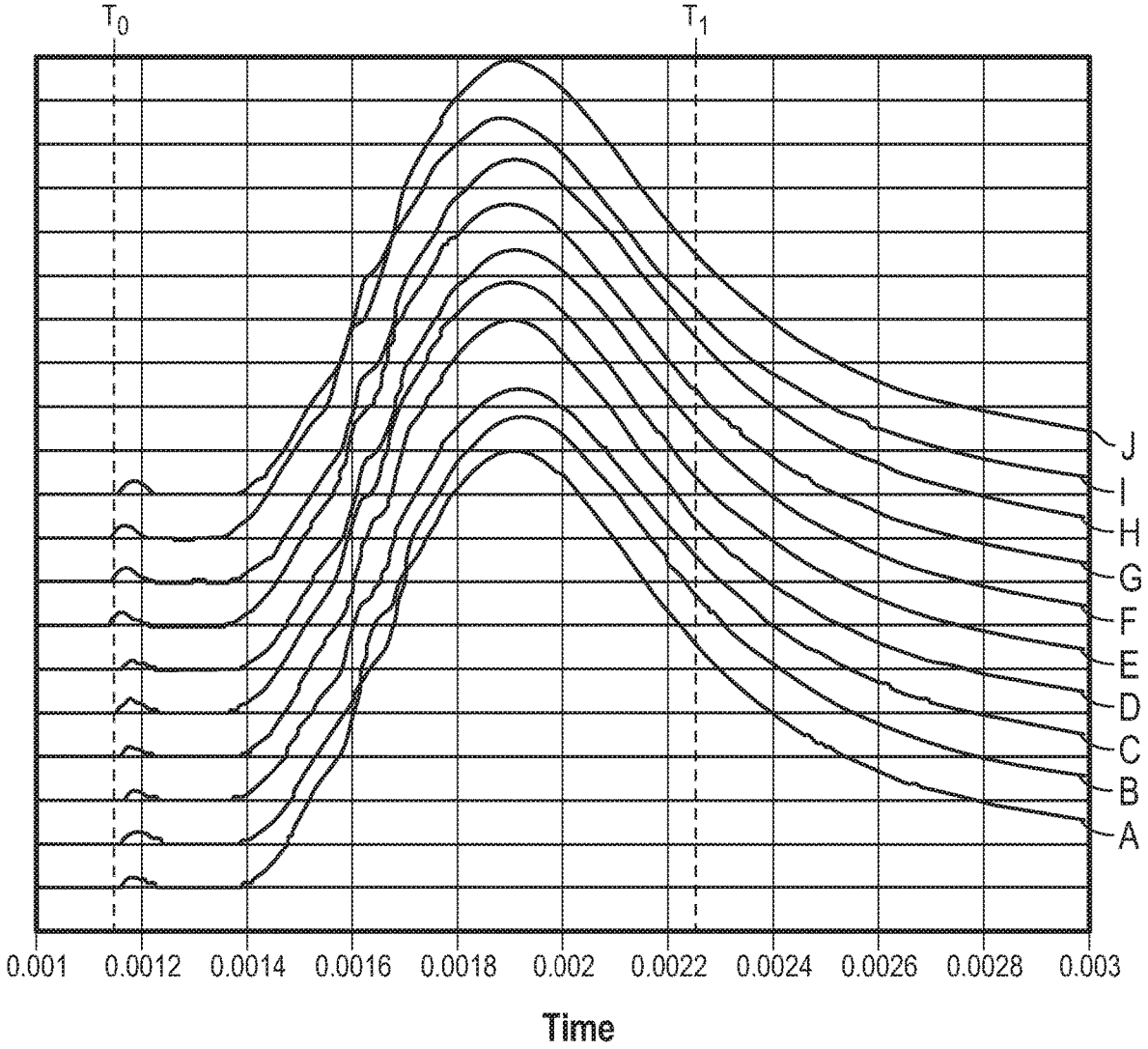
FIG. 12 is a P-T map showing the pressure v. time curves of multiple rounds fired from a ballistic test system incorporating the action timer start system disclosed herein.

The accuracy and repeatability of the action timer start switch 40 is best evidenced by ballistics data acquired from firing of multiple rounds of ammunition. FIG. 12 is a map of ten (10) pressure vs. time (P-T) data curves, each curve representing the ballistic data for a fired ammunition round. On this graph, the horizontal or x-axis represent the time between the start pulse ($T_0$) and the stop pulse ($T_1$). The vertical or y-axis represents the chamber pressure in the barrel 22 of the test weapon system 12 as measured by the chamber sensor 46. At switch closure, $T_0 \approx 0.001$ (1 millisecond), the primer strike occurs, as indicated by the small "bump" at about 0.0012 (1.2 milliseconds), that in turn ignites the propellant in the ammunition round for generating a pressure wave to release a projectile from a cartridge and propel the projectile through the rifled bore and out of the muzzle of the barrel at $T_1 \approx 0.0022$ (2.2 millisecond). By mapping ten curves on a single graph, it is readily seen that the primer bump for each shot are in alignment with each other, which indicates an accurate and repeatable start pulse from the action timer start switch. The bottom-most curve (A) represents the first shot, the next curve up (B) represents the second shot and so forth for the third through ninth shots represented by the curves progressing upwards (C-I) to the top-most curve (J) representing the tenth shot.

Figure 13:
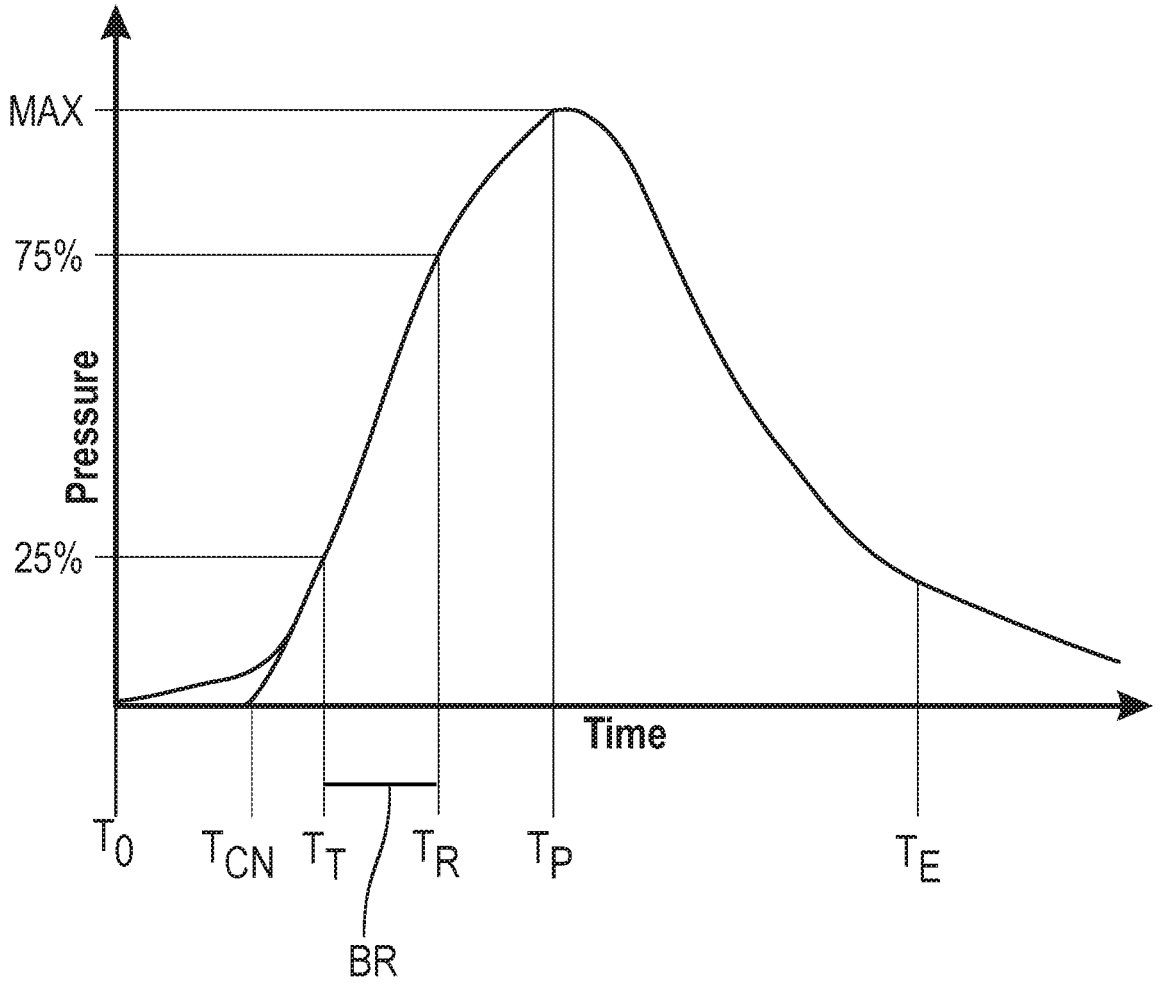
FIG. 13 is a single P-T curve identifying the critical pressure points on the curve for internal ballistic analysis.

FIG. 13 is a diagram showing how each P-T curve represented in FIG. 12 measures specific critical points for the internal ballistics analysis. Like FIG. 12, FIG. 13 shows the pressure vs. time (P-T) data for a given fired ammunition round. The x-axis represent time in milliseconds from the switch closure ($T_0$) to muzzle exit ($T_E$) for the duration of the Action Time and the y-axis represents the chamber pressure. Key internal ballistic events identified in FIG. 13 include: propellant ignition time ($T_{CN}$), time to threshold at 25% maximum pressure ($T_T$), time to rise at 75% maximum pressure ($T_R$), time to maximum pressure ($T_P$), and time to projectile exit ($T_E$), which for a 30-06 round occurs at about 1.76 milliseconds from switch closure. The propellant burn rate (BR) is the time period between 25% max pressure ($T_T$) and 75% max pressure ($T_R$). With this data for the action time and significant ballistic events within this relatively short time period, it becomes readily apparent how important accurate switch timing and start pulse reproducibility relative to primer strike is to the manufacture and subsequent testing of propellants and ammunition in the ballistics industry.

The foregoing description of the embodiments has been provided for purposes of illustration and description of a robust action timer start switch that provides accurate and repeatable timing signals, is resistant to fouling over time and multiple rounds and may be quickly and easily calibrated without having to disassembly the weapon test system. This detailed description is not intended to limit the scope of the claimed subject matter. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A breech block having an action timer switch comprising:
- a breech block body;
- a firing pin assembly including a firing pin plate supported in the breech block body, a firing pin slidably supported in the firing pin plate, wherein the firing pin is movable between a first position with the firing pin retracted into the firing pin plate and a second position with at least a portion of the firing pin extending from the firing pin plate;
- a hammer pivotally supported in the breech block body, the hammer including a hammer body having a first edge and a second edge opposite the first edge, a poll extending from the first edge and terminating at a hammer face, wherein the hammer is pivotable with respect to the breech block body for bringing the hammer face into contact with the firing pin; and
- an action start timer switch including:
  - an adjustable contact supported in the hammer body and extending through the first edge, wherein the adjustable contact terminates at a first contact element that is positionable relative to the hammer face; and
  - a contact switch fixedly supported in the breech block body, the contact switch having a second contact element electrically coupled to a test lead;
- wherein the first contact element contacts the second contact element when the hammer face contacts the firing pin for transmitting a start pulse in the test lead.

2. The breech block according to claim 1, wherein the adjustable contact comprises an elongated member received within a bore formed in the hammer body.

3. The breech block according to claim 2, wherein the elongated member comprises a threaded body received within a threaded portion of the bore.

4. The breech block according to claim 3, wherein the threaded portion of the bore further comprises a threaded insert disposed in the bore for receiving the threaded body.

5. The breech block according to claim 2, wherein an axis of the bore defines a lesser included angle with the second edge, wherein the lesser included angle is an acute angle greater than 45 degrees.

6. The breech block according to claim 5, wherein the lesser included angle is between 65 degrees and 75 degrees.

7. The breech block according to claim 1, wherein the contact switch comprises an insulator secured to the breech block body and supporting an electrically conductive member that is electrically isolated from breech block body.

8. The breech block according to claim 1, wherein the firing pin plate is removably secured to the breech block body.

9. The breech block according to claim 1, further comprising:
- a first spring mechanism operably disposed between the breech block body and the hammer;
- a second spring mechanism operably disposed between the firing pin plate and the firing pin;
- wherein the first spring mechanism biases the hammer into contact with the firing pin and the second spring mechanism biases the firing pin into the first position.

10. A system for conducting internal ballistic measurements comprising:
- a universal receiver having a breech and a breech block bore formed therein;
- a barrel extending from the universal receiver, the barrel having a first end adjacent the breech block bore forming a chamber region for receiving an ammunition round therein, a second end opposite the first end forming a muzzle region and a rifled bore extending from the chamber region to the muzzle region;

a breech block positionable in the breech block bore between an out-of-battery position for exposing the chamber region and an in-battery position for sealing the chamber region, the breech block having:

a breech block body;

a firing pin assembly including a firing pin slidably supported in a firing pin plate, wherein the firing pin is movable between a first position with the firing pin retracted into the firing pin plate and a second position with at least a portion of the firing pin extending from the firing pin plate; and a hammer pivotally supported in the breech block body, the hammer including a hammer body having a first edge and a second edge opposite the first edge, a poll extending from the first edge and terminating at a hammer face, wherein the hammer is pivotable with respect to the breech block body for bringing the hammer face into contact with the firing pin; and an action start timer switch including:

an adjustable contact supported in the hammer body and extending through the first edge, wherein the adjustable contact terminates at a first contact element that is positionable relative to the hammer face; and a contact switch fixedly supported in the breech block body, the contact switch having a second contact element electrically coupled to a test lead;

wherein the first contact element contacts the second contact element when the hammer face contacts the firing pin for transmitting a start pulse in the test lead.

11. The action timer start switch according to claim 10, wherein the adjustable contact comprises an elongated member received within a bore formed in the hammer body.

12. The action timer start switch according to claim 11, wherein the elongated member comprises a threaded body received within a threaded region of the bore.

13. The action timer start switch according to claim 12, wherein the threaded region of the bore comprises a threaded insert disposed in the bore for receiving the threaded body.

14. The action timer start switch according to claim 11, wherein an axis of the through bore defines a lesser included angle relative to the second edge, wherein the lesser included angle is an acute angle greater than 45 degrees.

15. The action timer start switch according to claim 14, wherein the lesser included angle is between 65 degrees and 75 degrees.

16. The action timer switch according to claim 10, wherein the hammer further comprises a pivot formed in the hammer body for pivotally coupling the hammer to the breech block.

17. The action timer switch according to claim 10, wherein the contact switch comprises an insulator supporting an electrically conductive member, wherein the insulator electrically isolates the electrically conductive member from breech block body.

18. The system according to claim 10 further comprising an action stop timing switch having a stop probe disposed at the muzzle region of the barrel and electrically coupled to a second lead, wherein the stop probe transmits a stop pulse in the second test lead when a projectile from the ammunition round is detected exiting the bore of the barrel.

19. The system according to claim 18, wherein the stop probe comprises an antenna bar disposed around the muzzle region of the barrel.

* * * * *